US007107875B2

(12) United States Patent
Haugen et al.

(10) Patent No.: US 7,107,875 B2
(45) Date of Patent: Sep. 19, 2006

(54) METHODS AND APPARATUS FOR CONNECTING TUBULARS WHILE DRILLING

(75) Inventors: David M. Haugen, League City, TX (US); Jeffrey Michael Habetz, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/382,080

(22) Filed: Mar. 5, 2003

(65) Prior Publication Data

US 2003/0221519 A1 Dec. 4, 2003

Related U.S. Application Data

(60) Continuation-in-part of application No. 10/011,049, filed on Dec. 7, 2001, now Pat. No. 6,668,684, which is a division of application No. 09/524,773, filed on Mar. 14, 2000, now Pat. No. 6,412,554.

(51) Int. Cl.
*B25B 17/00* (2006.01)
*E21B 3/04* (2006.01)
*E21B 19/16* (2006.01)

(52) U.S. Cl. ..... 81/57.15; 81/57.19; 81/57.33

(58) Field of Classification Search ..... 81/57.15, 81/57.19, 57.21, 57, 57.38, 57.44, 57.33, 81/57.37; 175/57, 113, 215, 195; 166/77.51, 166/78.1, 85.1
See application file for complete search history.

(56) References Cited

U.S. PATENT DOCUMENTS 1,386,908 A 8/1921 Taylor
1,842,638 A 1/1932 Wigle
2,214,194 A 9/1940 Frankley
2,214,429 A 9/1940 Miller
2,522,444 A 9/1950 Grable
2,610,690 A 9/1952 Beatty
2,633,333 A 3/1953 Storm
2,950,639 A 8/1960 Mason
3,021,739 A 2/1962 Grundmann
3,041,901 A 7/1962 Knights (Continued)

FOREIGN PATENT DOCUMENTS

EP 0285386 A2 3/1988

(Continued)

OTHER PUBLICATIONS

PCT Invitation to Pay Additional Fees and PCT Partial International Search Report from PCT/GB 01/01061, dated Aug. 29, 2001.

(Continued)

*Primary Examiner*—Hadi Shakeri
(74) *Attorney, Agent, or Firm*—Patterson & Sheridan, L.L.P.

(57) ABSTRACT

The present invention provides an apparatus that permits sections of tubulars to be connected to or disconnected from a string of pipe during a drilling operation. The apparatus further permits the sections of drill pipe to be rotated and to be axially translated during the connection or disconnection process. The apparatus further allows for the continuous circulation of fluid to and through the tubular string during the makeup or breakout process. The apparatus defines a rig assembly comprising a top drive mechanism, a rotary drive mechanism, and a fluid circulating device. Rotation and axial movement of the tubular string is alternately provided by the top drive and the rotary drive. Additionally, continuous fluid flow into the tubular string is provided through the circulation device and alternately through the tubular section once a connection is made between an upper tubular connected to the top drive mechanism and the tubular string.

19 Claims, 6 Drawing Sheets

U.S. PATENT DOCUMENTS 3,086,413 A 4/1963 Mason
3,122,811 A 3/1964 Gilreath
3,131,586 A 5/1964 Wilson
3,180,186 A 4/1965 Catland
3,193,116 A 7/1965 Kenneday et al.
3,220,245 A 11/1965 Van Winkle
3,302,496 A 2/1967 Mitchell et al.
3,349,455 A 10/1967 Doherty
3,443,291 A 5/1969 Doherty
3,475,038 A 10/1969 Matherne
3,518,903 A 7/1970 Ham et al.
3,559,739 A 2/1971 Hutchison
3,635,105 A 1/1972 Dickmann et al.
3,680,412 A 8/1972 Mayer et al.
3,722,331 A 3/1973 Radulescu
3,747,675 A 7/1973 Brown
3,766,320 A 10/1973 Homme
3,796,418 A 3/1974 Carlberg
3,808,916 A 5/1974 Porter et al.
3,838,613 A 10/1974 Wilms
3,933,108 A 1/1976 Baugh
3,941,348 A 3/1976 Mott
3,986,564 A 10/1976 Bender
4,005,621 A 2/1977 Turner, Jr. et al.
4,142,739 A 3/1979 Billingsley
4,159,637 A 7/1979 Lamb et al.
4,170,908 A 10/1979 Peveto et al.
4,221,269 A 9/1980 Hudson
4,246,809 A 1/1981 Keast et al.
4,257,442 A 3/1981 Claycomb
4,262,693 A 4/1981 Giebeler
4,291,762 A 9/1981 Gudgel
4,295,527 A 10/1981 Russe
4,315,553 A 2/1982 Stallings
4,334,444 A 6/1982 Carestensen et al.
4,346,629 A 8/1982 Kinzbach
4,401,000 A 8/1983 Kinzbach
4,402,239 A 9/1983 Mooney
4,437,363 A 3/1984 Haynes
4,442,892 A 4/1984 Delesandri
RE31,699 E 10/1984 Eckel
4,492,134 A 1/1985 Reinholdt et al.
4,494,424 A 1/1985 Bates
4,499,919 A 2/1985 Forester
4,565,003 A 1/1986 McLeod
4,570,706 A 2/1986 Pugnet
4,573,359 A 3/1986 Carstensen
4,593,773 A 6/1986 Skeie
4,643,259 A 2/1987 Zeringue, Jr.
4,709,599 A 12/1987 Buck
4,709,766 A 12/1987 Boyadjieff
4,712,284 A 12/1987 Coyle, Sr. et al.
4,715,625 A 12/1987 Shows, Jr. et al.
4,735,270 A 4/1988 Fenyvesi ..... 175/113
4,759,239 A 7/1988 Hamilton et al.
4,773,218 A 9/1988 Wakita et al.
4,800,968 A 1/1989 Shaw et al.
4,811,635 A 3/1989 Falgout, Sr.
4,813,493 A 3/1989 Shaw et al.
4,836,064 A 6/1989 Slator
4,867,236 A 9/1989 Haney et al.
4,878,546 A 11/1989 Shaw et al.
4,938,109 A 7/1990 Torres et al.
4,979,356 A 12/1990 Vatne
5,000,065 A 3/1991 Haynes
5,022,472 A 6/1991 Bailey et al. ..... 175/195
5,044,232 A 9/1991 Schulze-Beckinghausen
5,092,399 A 3/1992 Lang
5,150,642 A 9/1992 Moody et al.
5,159,860 A 11/1992 Pietras
5,161,438 A 11/1992 Pietras
5,161,548 A 11/1992 Neville
5,167,173 A 12/1992 Pietras
5,209,302 A 5/1993 Robichaux et al. ..... 166/355
5,221,099 A 6/1993 Jansch
5,251,709 A 10/1993 Richardson
5,259,275 A 11/1993 Schulze-Beckinghausen
5,282,653 A 2/1994 LaFleur et al. ..... 285/110
5,297,833 A 3/1994 Willis et al.
5,390,568 A 2/1995 Pietras
5,451,084 A 9/1995 Jansch
5,452,923 A 9/1995 Smith ..... 285/145
5,520,072 A 5/1996 Perry
5,547,314 A 8/1996 Ames ..... 405/165
5,577,566 A 11/1996 Albright et al.
5,634,671 A 6/1997 Watkins
5,645,131 A 7/1997 Trevisani
5,706,893 A 1/1998 Morgan
5,730,471 A 3/1998 Schulze-Beckinghausen et al.
5,746,276 A 5/1998 Stuart ..... 173/1
5,787,982 A 8/1998 Bakke
5,819,605 A 10/1998 Buck et al.
5,836,395 A 11/1998 Budde
5,839,330 A 11/1998 Stokka ..... 81/57.33
5,842,390 A 12/1998 Bouligny et al.
5,842,530 A 12/1998 Smith et al. ..... 175/162
5,845,549 A 12/1998 Bouligny
5,890,549 A 4/1999 Sprehe ..... 175/71
5,988,274 A * 11/1999 Funk ..... 166/77.4
5,992,801 A 11/1999 Torres
6,000,472 A 12/1999 Albright et al.
6,065,372 A 5/2000 Rauch
6,070,500 A 6/2000 Dlask et al.
6,082,224 A 7/2000 McDaniels et al.
6,082,225 A 7/2000 Richardson
6,119,772 A 9/2000 Pruet ..... 166/81.1
6,138,529 A 10/2000 Pietras
6,161,617 A 12/2000 Gjedebo
6,199,641 B1 3/2001 Downie et al.
6,206,096 B1 3/2001 Belik
6,223,629 B1 5/2001 Bangert
6,305,720 B1 10/2001 Spiering et al.
6,311,792 B1 11/2001 Scott et al.
6,315,051 B1 11/2001 Ayling ..... 166/380
6,327,938 B1 12/2001 Pietras
6,330,911 B1 12/2001 Allen et al.
6,360,633 B1 3/2002 Pietras
6,378,630 B1 4/2002 Ritorto et al. ..... 175/173
6,412,554 B1 7/2002 Allen et al. ..... 166/80.1
6,480,811 B1 11/2002 Denney et al.
6,527,062 B1 * 3/2003 Elkins et al. ..... 175/25
6,536,520 B1 3/2003 Snider et al.
6,591,916 B1 7/2003 Ayling
6,668,684 B1 12/2003 Allen et al.
2001/0042625 A1 11/2001 Appleton ..... 166/379
2002/0134555 A1 9/2002 Allen et al. ..... 166/377
2002/0157838 A1 10/2002 Ayling

FOREIGN PATENT DOCUMENTS

EP 0311455 A1 10/1988
EP 0423055 A2 7/1990
EP 0 525 247 2/1993
EP 0659976 A2 12/1994
GB 1 215 967 12/1970
GB 2 049 518 12/1980
GB 2 128 526 5/1984
GB 2 300 896 11/1996
GB 2 346 576 8/2000
GB 2 346 577 8/2000
WO WO 83/03443 10/1983
WO WO 92/18744 10/1992
WO WO 93/18276 9/1993
WO WO 95/20471 8/1995

| | | |
|---|---|---|
| WO | WO 96/18799 | 6/1996 |
| WO | WO 98/11322 | 3/1998 |
| WO | WO 98/16716 | 4/1998 |
| WO | WO 98/32948 | 7/1998 |
| WO | WO 99/34089 | 7/1999 |
| WO | WO 99/34090 | 7/1999 |
| WO | WO 99/34091 | 7/1999 |
| WO | WO 00/22278 | 4/2000 |
| WO | WO 00/23686 | 4/2000 |
| WO | WO 00/45026 | 8/2000 |
| WO | WO 00/45027 | 8/2000 |
| WO | WO 00/79092 A2 | 12/2000 |
| WO | WO 01/03889 | 1/2001 |
| WO | WO 01/09479 | 2/2001 |
| WO | WO 01/38688 | 5/2001 |
| WO | WO 01/66905 | 9/2001 |
| WO | WO 02/36928 | 5/2002 |

OTHER PUBLICATIONS 500 or 650 ECIS Top Drive, Tesco Drilling Technology, Apr. 1998.
500 or 650 HCIS Top Drive, Tesco Drilling Technology, Apr. 1998.
More Portable Top Drive Installations, Tesco Drilling Technology, 1997.
Top Drive Drilling Systems, Canrig, Feb. 1997 in Hart's Petroleum Engineer.
Product Information, Sections 1-10, Canrig, 1996.
Valves, Wellhead Equipment Safety Systems, W-K-M Division, ACD Industries, 1980.
Portable Top Drives: What's Driving The Market? Drilling Contractor, Sep. 1994.
Autoseal Circulating Head, LaFleur Petroleum Services, Inc., 1992.
U.K. Search Report, Application No. GB0405064.7, dated Jun. 23, 2004.

* cited by examiner

METHODS AND APPARATUS FOR CONNECTING TUBULARS WHILE DRILLING

STATEMENT OF RELATED APPLICATIONS

This application is a continuation-in-part of a U.S. patent application Ser. No. 10/011,049, and was filed Dec. 7, 2001 now U.S. Pat. No. 6,668,684 and is also incorporated by reference in its entirety. The parent application is entitled "Improved Tong for Wellbore Operations."

The parent patent application was filed as a division of U.S. Ser. No. 09/524,773. That application was filed on Mar. 14, 2000, and was entitled "Wellbore Circulation System." That application has now issued as U.S. Pat. No. 6,412,554 to Allen, et al and is incorporated by reference in its entirety.

BACKGROUND OF THE INVENTION

1. Field of the Invention

The present invention generally relates to methods and apparatus for the continuous drilling of a wellbore through an earth formation. More particularly, the present invention pertains to the continuous circulation of fluid through two tubulars that are being connected or disconnected during a wellbore drilling operation. In addition, embodiments of the present invention relate to continuously rotating and axially advancing two drill pipes into a wellbore while circulating drilling fluid through the two drill pipes and forming a connection between the two drill pipes.

2. Description of the Related Art

In the drilling of oil and gas wells, a wellbore is formed using a drill bit that is urged downwardly at a lower end of a drill string. The wellbore extends from the earth's surface to a selected depth in order to intersect a hydrocarbon-bearing formation. In many drilling operations, the drill string comprises a plurality of "joints" of drill pipe that are threadedly connected at the platform of the drilling rig. As the wellbore is formed at lower depths or more extended intervals, additional joints of pipe are added at the platform. These joints are then rotated and urged downwardly in order to form the wellbore.

During the drilling process, drilling fluid is typically circulated through the drill string and back up the annular region formed by the drill string and the surrounding formation. As the drilling fluid is circulated, it exits ports, or "jets," provided in the drill bit. This circulation of fluid serves to lubricate and cool the bit, and also facilitates the removal of cuttings and debris from the wellbore that is being formed.

One common method for providing rotation to the drill string involves the use of a kelly bar. The kelly bar is attached to the top joint of the drill string, and is driven rotationally by means of a rotary table at the derrick floor level. At the same time, the kelly bar is able to move vertically through a drive bushing within the rotary table at the rig floor. An alternative method for imparting rotation to the drill string uses a top drive that is hung from the derrick and is capable of gripping the drill string and rotating it. In such an arrangement, a kelly bar is not required.

As the drill bit penetrates into the earth and the wellbore is lengthened, more sections of hollow tubular drill pipe are added to the top of the drill string. This involves stopping the drilling, i.e., rotational and axial translation of the drill pipe, while the successive tubulars are added. The process is reversed when the drill string is removed. Drill string removal is necessary during such operations as replacing the drilling bit or cementing a section of casing. Interruption of drilling may mean that the circulation of the mud stops and has to be re-started when drilling resumes. Since the mud is a long fluid column, the resumption of circulation throughout the wellbore can be time consuming. Such activity may also have deleterious effects on the walls of the wellbore being drilled, leading to formation damage and causing problems in maintaining an open wellbore.

Intermittent cessation of fluid circulation may require additional weighting of the mud. In this respect, a particular mud weight must be chosen to provide a static head relating to the ambient pressure at the top of a drill string when it is open while tubulars are being added or removed. The additional weighting of the mud to compensate for cessation of fluid circulation adds expense to the operation.

One purpose of fluid circulation while drilling relates to the suspension of cuttings. To convey drilled cuttings away from a drill bit and up the wellbore, the cuttings are maintained in suspension in the drilling fluid. When the flow of fluid ceases, such as when adding or removing a section of drill pipe, the cuttings tend to fall down through the fluid. To inhibit cuttings from falling out, the drilling mud is further weighted, and viscosity is reduced. The use of thicker drilling fluids requires more pumping power at the surface. Further, the act of "breaking" the pumps to restart fluid circulation following a cessation of circulation may result in over pressuring of a downhole formation. This can trigger formation damage or even a loss of fluids downhole, endangering the lives of the drilling crew due to loss of hydrostatic pressure. Of course, the additional weighting of drilling mud adds expense to the drilling operation.

Systems and methods for continuously circulating fluid through two tubulars that are being connected or disconnected are disclosed in U.S. Pat. No. 6,412,554. The '554 patent is assigned to Weatherford/Lamb, Inc. The '554 patent is incorporated herein by reference, in its entirety. The systems and methods of the '554 patent allow for continuous fluid circulation during the drilling operation; however, rotation of the drill string must still be stopped and re-started in order to connect and disconnect the tubulars. Therefore, valuable time loss occurs when drilling stops in order to connect the next successive section of drill pipe. Additionally, starting rotation of the drill string can over torque portions of the drill string, causing failure from the additional stress.

U.S. Pat. No. 6,315,051 discloses methods and apparatus for both continuously rotating a tubular string and continuously circulating fluid through the tubulars as sections of pipe are added or removed. However, inability to continue to advance the tubular string down the borehole during the connection process temporarily stops drilling into the formation. The wellbore forming process is thus stopped temporarily in order to make up or break out the successive pipe connections.

Therefore, there is a need for efficient methods and apparatus for connecting and disconnecting tubular sections while at the same time rotating and axially translating a tubular string there below, and while continuously circulating fluid through the tubular string.

SUMMARY OF THE INVENTION

The present invention first provides an apparatus that permits sections of tubulars, such as drill pipe, liner and casing to be connected to or disconnected from a string of pipe during a drilling operation. The apparatus further permits the sections of drill pipe to be both rotated and axially translated during the connection or disconnection process. The apparatus further allows for the continuous circulation of fluid to and through the tubular string during the makeup or breakout process.

The apparatus first comprises a fluid circulation device. In one arrangement, the fluid circulation device comprises an upper chamber and a lower chamber. The upper chamber receives an upper tubular, while the lower chamber receives the top tubular of a tubular string. Each chamber has a top opening and a bottom opening for receiving their respective tubulars. In addition, each chamber includes a sealing apparatus for sealingly encompassing a portion of the respective upper and top tubulars.

A gate apparatus is provided between the upper chamber and the lower chamber. The gate apparatus is in fluid communication with both the upper chamber and the lower chamber. The gate apparatus may be selectively closed to seal off the flow of drilling fluids between the two chambers.

The apparatus of the present invention also comprises a pair of drives. The first drive is a rotary drive, while the second drive is a top drive. The rotary drive operates on the derrick floor, while the top drive is suspended above the floor. Rotation and axial movement of the tubular string is alternately provided by the top drive and the rotary drive. An embodiment of the rotary drive can engage the tubular string and move it axially in the wellbore.

One of the upper and lower chambers of the circulation device is sized for accommodating connection and disconnection therein of the upper tubular and the top tubular. The connection or disconnection process may be accomplished without interrupting circulation of fluid through the tubular string. In this respect, continuous fluid flow into the tubular string is provided by alternately circulating fluid through the circulation device and through a separate flow path in fluid communication with the top of the upper tubular. Fluid is circulated through the separate flow path into the top of the upper tubular when the top drive is connected to the tubular. In addition, the connection or disconnection process may be accomplished without interrupting the rotary and axial movement of the tubular string during the drilling process.

The present invention also provides a method for connecting or disconnecting sections of tubulars, such as drill pipe, to or from a string of pipe during a drilling operation. For purposes of this summary, we will state that the method is for connecting an upper tubular of a drill string to the top tubular of the drill string during a wellbore forming process. We will also state for purposes of example that the lower chamber is the chamber that is configured to permit connection of the upper tubular to the top tubular of the drill string. However, it is understood that the methods of the present invention also provide for disconnecting the upper tubular from the top tubular, and permit the use of the upper chamber as the chamber in which connection or disconnection of the upper tubular from the top tubular takes place. In addition, it is understood that the methods of the present invention have equal application when tripping the drill string out of the hole, as opposed to advancing the drill string downwardly.

According to the exemplary method, the tubular string, e.g., drill pipe, is rotated and advanced downwardly by a top drive. At the same time, fluid circulation through the drill string is provided through a top drive tubular. As the drill string is advanced into the wellbore, the top end of the top tubular reaches a position such that its top end resides within the lower chamber of the apparatus described above. Once the top end of the top tubular is completely positioned within the lower chamber, fluid circulation through the top drive and upper tubular is discontinued. The upper tubular is disconnected from the top drive mechanism, and the gate is closed in order to seal off the flow of fluid between the upper and lower chambers.

When the connection between the top drive tubular and the top tubular of the drill string is broken, rotary movement of the drill string is no longer imparted by the top drive. In order to maintain rotary movement, the rotary drive in the floor of the rig is actuated. The novel rotary drive system in the floor of the rig is configured to also provide limited axial movement of the drill string.

When the connection between the top drive tubular and the top tubular of the drill string is broken, fluid circulation can no longer be provided by the top drive tubular. At this point, fluid circulation is diverted from the top drive tubular, and into the fluid circulation device. More specifically, fluid is injected into the lower chamber through an injection tubular. From there, fluid is passed down into the drill string and circulated through the wellbore.

As a next step, a new upper tubular is connected to the top drive. The bottom end of the upper tubular is then aligned with the drill string and lowered into the top opening of the upper chamber of the fluid circulation device. The upper tubular continues to be lowered until its bottom end passes through seals in the upper chamber, e.g., stripper rubbers. The gate in the circulation device is then opened, and fluid is once again circulated through the top drive mechanism and the upper tubular. The relative rates of speed of the top drive mechanism and the rotary drive mechanism are adjusted in order to make up the bottom end of the upper tubular to the top end of the top tubular of the drill string. At that point, rotation and axial movement of the drill string by the top drive only resumes.

BRIEF DESCRIPTION OF THE DRAWINGS

So that the manner in which the above recited features of the present invention can be understood in detail, a more particular description of the invention, briefly summarized above, may be had by reference to embodiments illustrated in the appended drawings.

FIG. 2A shows the top drive adapter being lowered into a surrounding joint of drill pipe. FIG. 2B shows the top drive adapter having been locked into the joint of drill pipe for manipulation of the drill pipe.

DETAILED DESCRIPTION OF THE PREFERRED EMBODIMENT

Figure 1:
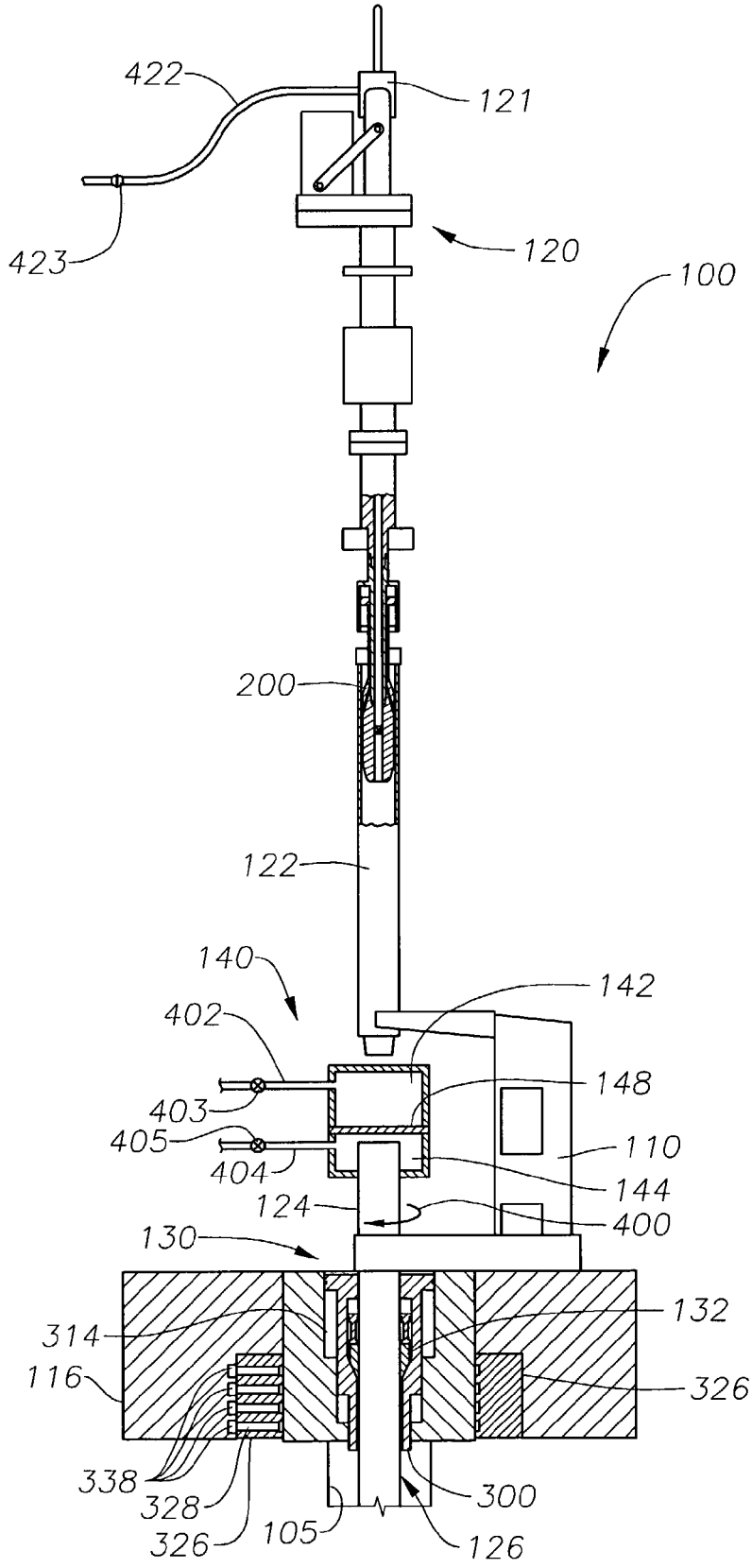
FIG. 1 presents a sectional view of an embodiment of a rig assembly for continuously drilling. In this view, a top drive mechanism is seen configured above a rotary drive mechanism. The top drive mechanism is grasping an upper tubular, and is lowering the upper tubular downward towards a top tubular of a drill string. The drill string is being rotated by the rotary drive mechanism. Thus, the rig assembly is in its rotary drive drilling position.

FIG. 1 presents a sectional view of an embodiment of a rig assembly 100 for continuously drilling. A wellbore 105 is being formed by operation of the rig assembly 100. As will be described, the novel rig assembly 100 provides three basic components: (1) a top drive mechanism 120, (2) a rotary drive mechanism 130, and (3) a fluid circulating device 140 disposed between the top drive mechanism 120 and the rotary drive mechanism 130. Each of these three components is seen in FIG. 1.

The rig assembly 100 of FIG. 1 is intended to primarily show the relative positions of the top drive mechanism 120, the rotary drive mechanism 130 and the fluid circulating device 140. It is understood that numerous other components of a typical drilling rig exist but are not shown. Examples of such components (not shown) include the V-door, the pipe rack, the elevators, the derrick structure and the dope bucket. However, several additional rig components are seen in the drawing of FIG. 1.

First, the platform of the rig 100 is seen at 116. The platform 116 may be immediately above the earth surface (as in a land rig), or may be above the surface of water (as in an offshore rig). In this respect, the present invention is not limited to either type of rig arrangement.

Second, a support structure 110 is provided above the rig platform 116. The support structure 110 serves to guide drill pipe 122 as it is lowered into a wellbore 105 there below. Such support structure 110 is commonly used on a rig which provides a top drive arrangement. As will be shown below, the support structure also aids in supporting the circulating device 140.

In the view of FIG. 1, the top drive mechanism 120 is seen configured above the rotary drive mechanism 130. The top of the top drive mechanism 120 includes a drill swivel 121. It can be seen that the top drive mechanism 120 is grasping an upper tubular 122. At the same time, the top drive mechanism 120 and the attached upper tubular 122 are being lowered downward towards the rig platform 116. More specifically, the upper tubular 122 is being moved downward so that it can be connected to a top tubular 124 of a drill string 126. In this specification, the terms "tubular" and "drill pipe" or "drill string" include all forms of tubulars including casing and even drilling with casing.

Figure 2A:
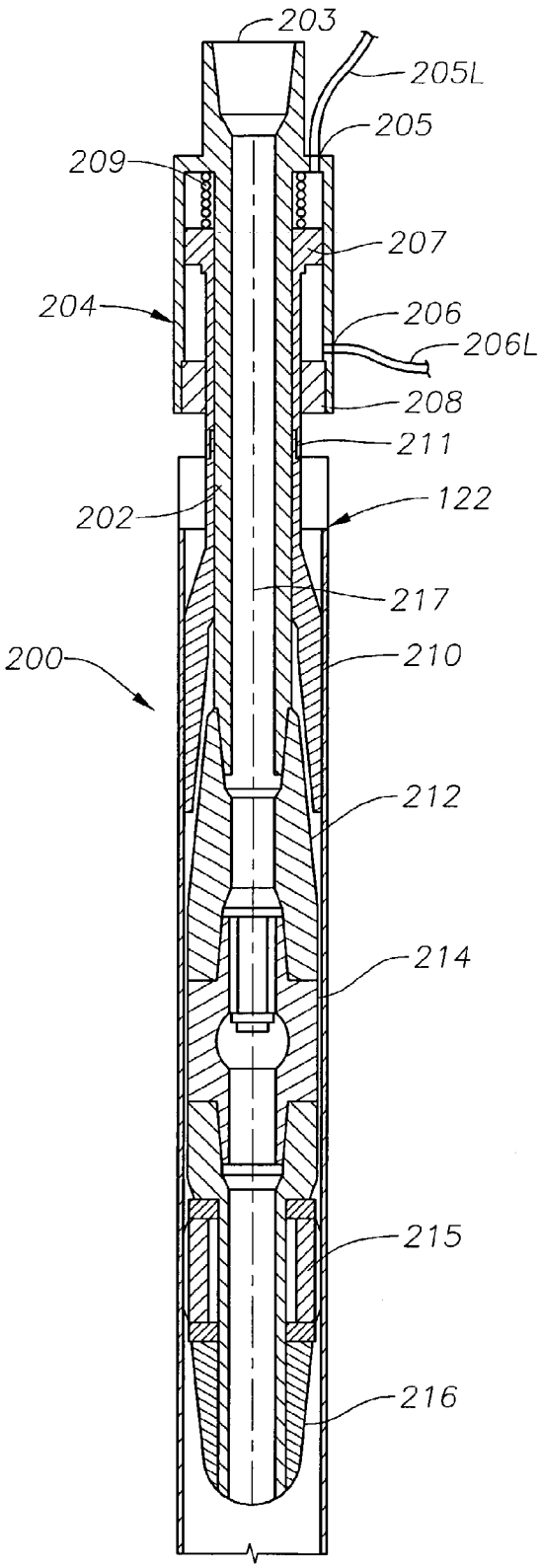
FIGS. 2A and 2B provide cross-sectional views of a top drive adapter as might be employed with the top drive mechanism of the present inventions.
Figure 2B:
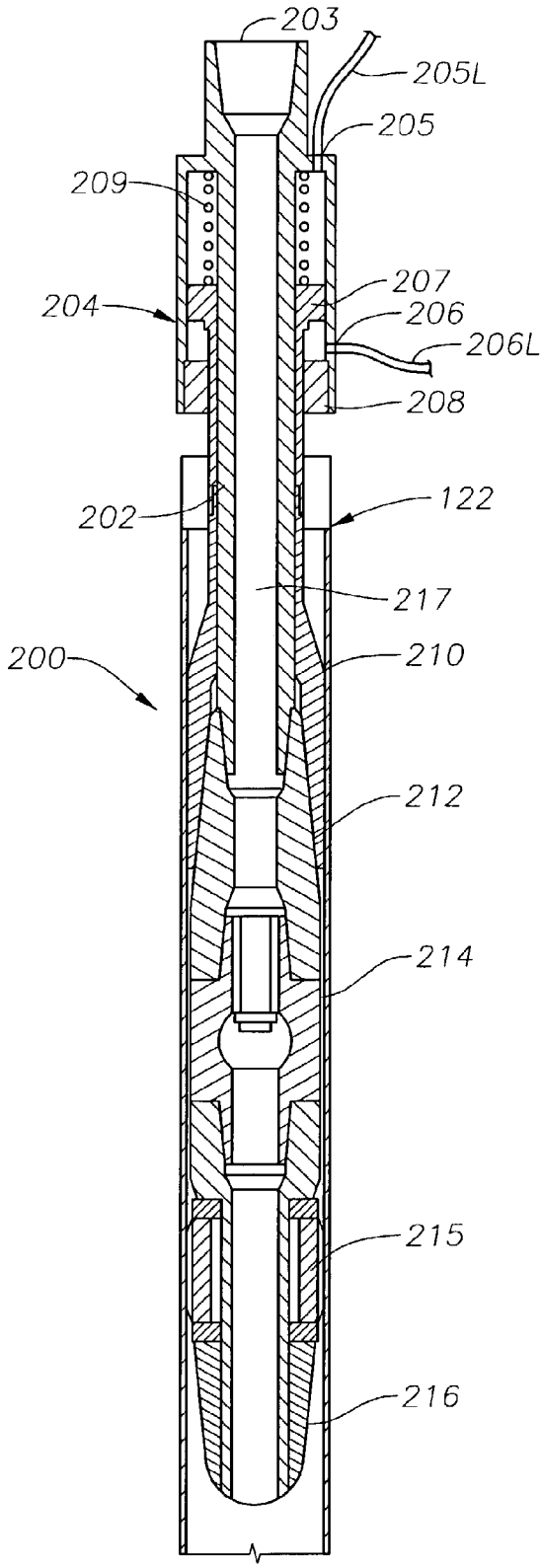

In order to provide a connection between the top drive mechanism 120 and the upper tubular 122, a top drive adapter 200 is optionally employed. Cross-sectional views of the top drive adapter are shown in FIGS. 2A and 2B at 200.

In one arrangement, the top drive adapter 200 comprises a cylindrical body 202 with a threaded connection 203 at the upper end for connection to the top drive 120. Attached to the cylindrical body 202, or machined into it, is a hydraulic cylinder 204. The hydraulic cylinder 204 has a pair of threaded ports 205, 206 at opposite ends. Ports 205 and 206 permit hydraulic fluid to be injected under pressure to manipulate a hydraulic piston 207. The hydraulic piston 207 is secured within the cylinder 204 by a threaded lock ring 208. A compression spring 209 is located in the cylinder 204 above the piston 207.

A grapple 210 is provided around the cylindrical body 202 below the hydraulic cylinder 204. The grapple 210 includes serrated teeth machined into its outer surface. The grapple 210 is connected to the hydraulic piston 207 by a threaded connection 211. A corresponding wedge lock 212 is provided on the cylindrical body 202. The grapple 210 and corresponding wedge lock 212 are located, in use, inside a drill pipe 122, as shown in FIGS. 2A and 2B. The piston 207 and lock ring 208 are fitted with seal rings (not shown) to prevent hydraulic fluid leakage.

A mud-check valve 214 is threadedly connected at the lower end of the wedge lock 212. Below this valve 214 is a rubber pack-off assembly 215. The mud-check valve 214 and the pack-off assembly 215 prevent spillage of drilling fluid when the top drive adapter 200 is removed from within the drill pipe joint 122. The pack-off assembly 215 can be energized by either internal mud pressure or external mud flow.

In operation, the top drive adaptor 200 is lowered into the drill pipe joint 122. A stabbing guide 216 is provided at the lower end of the adapter 200 as an aid. For purposes of the present inventions, the drill pipe joint 122 represents the upper tubular to be connected to a drill string 126. More specifically, the upper tubular 122 is to be connected to the top tubular 124 of the drill string 126 shown in FIG. 1. FIG. 2A depicts the adaptor 200 having been lowered into the drill pipe joint 122. The grapple 210 is held out of contact with the wedge lock 212 by hydraulic fluid injected into port 206, and the area of the hydraulic cylinder 204 below the piston 207. Fluid is supplied through a connected hydraulic line 205L.

When the top drive adaptor 200 is located at the correct installation depth within the drill pipe 122, the pressure and fluid is released from port 206, and fluid is injected into the port 205. Fluid then enters the area of the hydraulic cylinder 204 above the piston 207. Fluid is supplied through a second connected hydraulic line 206L. This pushes the piston 207 downward, pressing the grapple 210 against the wedge lock 212. The wedge lock 212, forming a mechanical friction grip against the inner wall of the drill pipe 122, forces the grapple 210 outwards. The locking arrangement between the top drive adaptor 200 and the pipe, e.g, upper tubular 122, is shown in the cross-sectional view of FIG. 2B.

After the top drive adaptor 200 is latched into the upper tubular 122, the rig lifting equipment (not shown) raises the top drive adaptor 200. This causes the wedge lock 212 to be pulled upwards against the inner surface of the grapple 210. This, in turn, ensures that constant outward pressure is applied to the grapple 210 in addition to the hydraulic pressure applied to the piston 207 through port 205. The grip becomes tighter with increasing pull exerted by the rig lifting equipment. Should hydraulic pressure be lost from port 205, the compression spring 209 ensures that the piston 207 continues to press the grapple 210 against the wedge lock 212, preventing release of the grapple from the wedge lock.

The top drive mechanism 120, including the adaptor 200 and connected upper tubular 122, are lowered downward towards the wellbore 105. Hydraulic fluid is then pumped out of port 205 and into port 206 to release the grapple 210 from the wedge lock 212 and to release the top drive adaptor 200 from the upper tubular 122. The top drive adaptor 200 is then removed from the upper tubular 122. The process is repeated in order to pick up and run additional tubular members into the wellbore 105 during a wellbore forming process.

FIG. 1 also shows a rotary drive mechanism 130. In one embodiment, the rotary drive mechanism 130 is built into the platform 116 of the drilling rig 100. The purpose of the rotary drive mechanism 130 is to transfer a rotational force to the drill string 126 during those times when the top drive mechanism 120 is not transferring the rotational force. FIG. 1 shows the rig assembly 100 in its rotary drive drilling position.

To effectuate rotational force by the rotary drive mechanism 130, the rotary drive mechanism 130 is provided with slips 132 that grip the top tubular 124 of the tubular string 126. In the view of FIG. 1, the slips 132 are shown gripping the top tubular 124. This prevents rotational and axial movement of the top tubular 124 and connected drill string 126 relative to the rotary drive 130. However, the rotary drive mechanism 130 itself is being rotated within the platform 116 in order to rotate the drill string 126 that is held by the slips 132. Operation of the slips 132 is shown and described in greater detail below in connection with FIG. 3.

In accordance with the present invention, it is desired to not only transmit rotational force to the drill string 126, but axial force as well. Thus, the rotary drive mechanism 130 of the present invention is also equipped with an axial displacement piston 300. The axial displacement piston 300 permits the tubular string 126 to be advanced into the wellbore 105 even while the tubular string 126 is not mechanically connected to the top drive mechanism 120. To accomplish this, the slips 132 that engage the top tubular 124 of the tubular string 126 move with the axial displacement piston 300.

Figure 3:
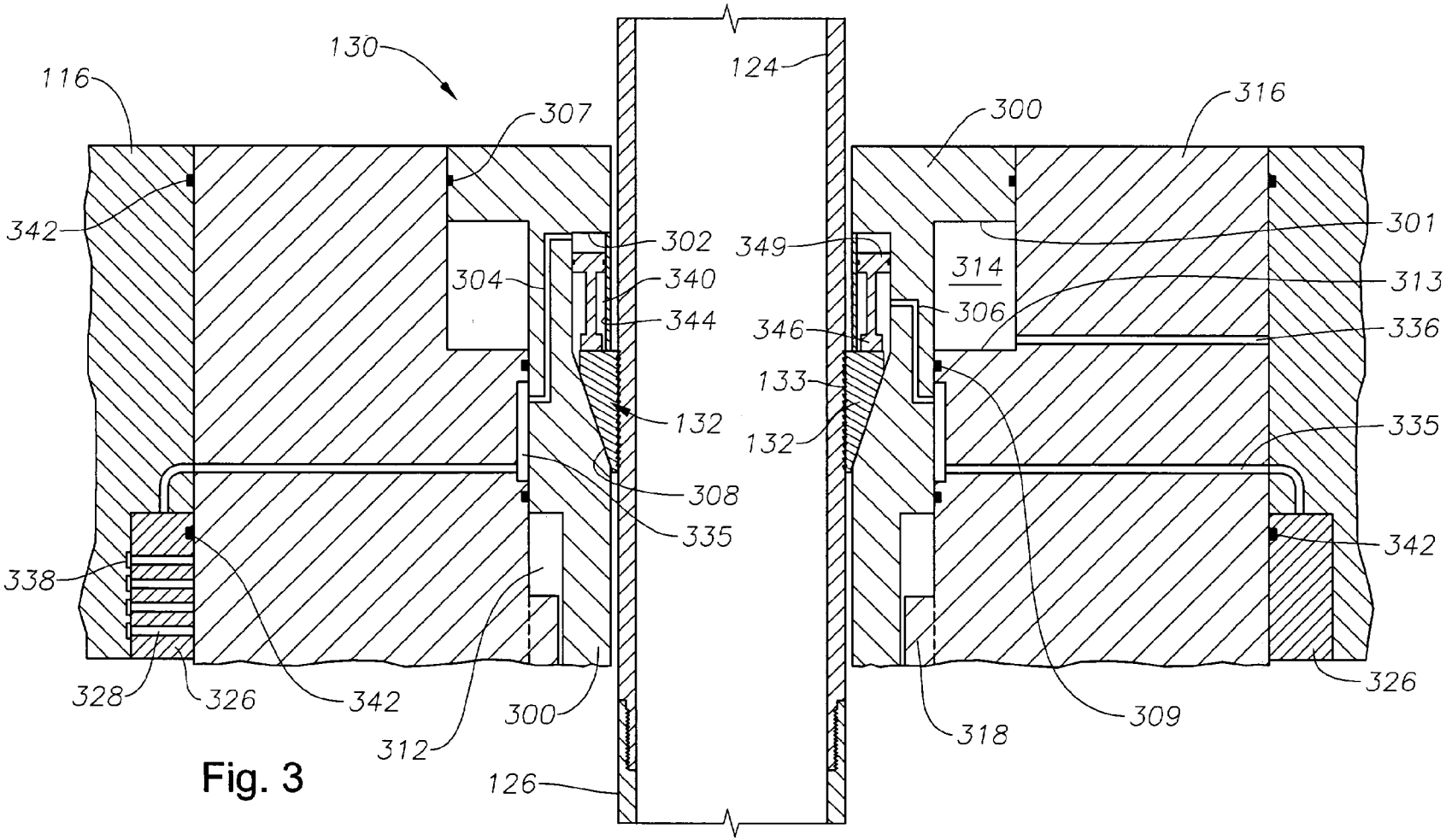
FIG. 3 is an enlarged cross-sectional view of the rotary drive mechanism used in the rig assembly of FIG. 1, in one embodiment. A top tubular of the drill string is seen within the rotary drive mechanism. Slips have frictionally engaged the top tubular of the drill string for both rotation and axial movement.

FIG. 3 presents an enlarged cross-sectional view of the rotary drive mechanism 130 used in the rig assembly of FIG. 1, in one embodiment. A top tubular 124 of the drill string is seen within the rotary drive mechanism 130. The top tubular 124 is secured by the slips 132. The slips 132, in turn, reside along an inclined inner surface 308 of the axial displacement piston 300. The slots 132 are rotationally driven by a rotary table 316 in the rig floor 116. However, any such apparatus as would be known to those of ordinary skill in the drilling art may be used for imparting rotation.

As illustrated in FIG. 3, the slips 132 comprise at least one wedge-shaped member positioned adjacent to an inclined surface 308 of the inside diameter of the axial displacement piston 300. Each of the slips 132 projects out from the inclined surface 308, and each slip 132 has a tubular gripping edge 133 facing away from the axial displacement piston 300. The gripping edge 133 preferably defines wickers, teeth, particulate material bonded to the slips, or other roughened surface to facilitate the frictional engagement of the slips 132 to the top tubular 124. This type of slip 132 allows rotational torque to be imparted to the tubular string 126. At the same time, the slips 132 resist longitudinal forces produced by circulating fluid within the tubular string and the weight of the tubular string. In this arrangement; a kelly bar is not required to be added to the tubular string 126. Channels (not shown) are formed between adjacent slips 132 to accommodate debris from the outer surface of the tubular string 126.

In the arrangement shown in FIG. 3, the axial displacement piston 300 defines a tubular body having an inner surface and an outer surface. The inner surface of the axial displacement piston 300 generally forms a bore configured to slideably receive joints of pipe, e.g., pipe 124. A first upper shoulder 301 is formed at the top of the axial displacement piston 300 and along the outer surface. A second upper shoulder 302 is formed at the top of the axial displacement piston 300 and along the inner surface.

As again seen in FIG. 3, the slips 132 reside along an inclined inner surface 308 of the axial displacement piston 300. The inclined inner surface 308 is below the second upper shoulder 302. Each slip 132 is connected to and actuated by a slip piston 340. The slip pistons 340 reside between the second upper shoulder 302 and the respective slips 132. In one aspect, the slip pistons 340 are sealingly housed within a slip piston housing 344, with the slip pistons 340 being vertically movable within the slip piston housing 344. As will be seen, movement of the slip pistons 340 allows the slips 132 to selectively engage and disengage the top tubular 124.

The slip pistons 340 are configured and arranged to move within the slip piston housing 344 in response to fluid pressure. A pair of hydraulic lines 304, 306 feed into the slip piston housing 344 to urge the respective slip pistons 340 either upwardly or downwardly. In one arrangement, and as shown in FIG. 3, the slip pistons 340 each have an upper end 349 that divides the slip piston housing 344 so as to form separate fluid chambers for receiving fluid from line 304 or line 306, respectively. The slip pistons 340 also have a lower end 346 (or other connector) for connecting the slip pistons 340 to the slip members 132. In this way, axial movement of the slip pistons 340 in turn moves the slip members 132.

As noted, the rotary drive mechanism 130 also comprises a rotary table 316. The rotary table 316 is disposed within the platform 116 of the rig 100. The rotary table 316 employs a novel configuration that permits it to receive the axial displacement piston 300. To this end, the axial displacement piston 300 concentrically resides within the rotary table 316.

Slots 312 are formed along the length of a lower portion of the axial displacement piston 300. The slots 312 receive respective keys 318 extending inward from and formed by the rotary table 136. There can be two, three, four, or more slots 312 for receiving respective keys 318. The slots 312 are adapted to provide a pathway for the keys 318 to travel along the axial movement of the axial displacement piston 300 relative to the rotary drive 130. Interaction between the axial displacement piston 300 and the rotary table 316 at the location of the slots 312 and the keys 318 prevents rotation between the rotary table 316 and the axial displacement piston 300 while allowing relative axial movement. Based upon this disclosure, one skilled in the art could alternately envision utilizing a slot within the rotary drive 130 to receive a key extending outward from the axial displacement piston 300 in order to rotationally lock the axial displacement piston 300 with respect to the rotary drive 130.

A piston chamber 314 is formed between the rotary table 316 and the axial displacement piston 300. The piston chamber 314 is defined by the first upper shoulder 301 in the axial displacement piston 300, and a lower shoulder 313 in the rotary table 316. The piston chamber 314 receives fluid under pressure. By manipulating the level of pressure within the piston chamber 314, the axial position of the axial displacement piston 300 relative to the rig platform 116 and the rotary table 136 is controlled.

In the arrangement of FIG. 3, the weight of the tubular string 126 urges the axial displacement piston 300 downward when the slips 132 engage the top tubular 124. Pressure is permitted to slowly bleed out of the piston chamber 314 through a third hydraulic line 336. As pressure is relieved from within the piston chamber 314, downward movement of the tubular string 126 is permitted to occur. When it is desired to raise the axial displacement piston 300, fluid under pressure is reinjected through the hydraulic line 336 and into the piston chamber 314. Chamber seals 307, 309 serve to seal the interface between the axial displacement piston 300 and the surrounding rotary table 316. A powerful compression spring (not shown) may also be used in the piston chamber 304 to help bias the axial displacement piston 300 upward.

The rotary drive mechanism 130 also comprises a stationery slip ring 326. The stationery slip ring 326 is positioned around the outside of the rotary table 316. The stationery slip ring 326 provides couplings 338 to secure the fluid lines 336, 304, 306 between the rotary table 130 and the stationery platform 116. These fluid pathways 336, 304, 306 provide the fluid necessary to operate the piston chamber 314 and the slip pistons 340, respectively. The fluid pathways 304, 306 port to the outside of the rotary table 316 and align with corresponding recesses 328 along the inside of the slip ring 326. Seals 342 prevent fluid loss between the rotary table 316 and the slip ring 326. As shown, fluid pathways 304, 306 pass through the slip ring 326 to a central manifold portion of the slip ring 326 where couplings 338 are provided for connecting hydraulic lines or hoses thereto that supply the fluid pathways 304, 306.

In operation, hydraulic fluid is injected under pressure into line 304. This injects fluid into the top portion of the slip piston housing 344 above the shoulder 349. This, in turn, urges the slip pistons 340 downward. Because the slip pistons 340 are connected to the slips 132 via connector members 346, the slips 132 are urged to slide downwardly against the inclined inner surface 308 and into frictional engagement with the top tubular 124. In this way, rotational movement of the rotary drive mechanism 130 imparts rotary motion to the drill string 126.

When it is desired to release the slips 132 from the top tubular 124, hydraulic pressure is released from line 304 where it is rerouted into line 306. Line 306 delivers the fluid into the slip piston housing 344 below the upper end 349 of the slip piston members 340. Thus, controlling fluid pressure through fluid pathways 304, 306 moves the piston members 340.

It should be added that a longitudinal cavity 335 may be provided on the inside of the rotary table 316 to maintain the fluid lines 304 and 306. In the embodiment shown in FIG. 3, the longitudinal cavity 335 is placed between the axial displacement piston 300 and the inner diameter of the rotary table 316. The cavity 335 is provided along the entire axial movement of the axial displacement piston 300.

As indicated above, the rig assembly 100 of the present invention finally comprises a fluid circulating device 140. The fluid circulating device 140 is seen in FIG. 1 as being disposed below the top drive mechanism 120, but above the rotary drive mechanism 130. The fluid circulating device 140 is also shown supported by the supporting structure 110.

The fluid circulating device 140 is comprised of two chambers—an upper chamber 142 and a lower chamber 144. Each chamber 142, 144 has a bottom opening and a top opening. The respective top and bottom openings are configured to receive tubulars, such as drill pipes 122 and 124. An upper sealing apparatus (not shown) is provided in the upper chamber 142 for sealingly encompassing a portion of the tubular 122 as it passes therethrough. Likewise, a lower sealing apparatus (not shown) is provided in the lower chamber 144 for sealingly encompassing a portion of the tubular string 126 as it passes therethrough. Preferably, the upper tubular 122 and the tubular string 126 enter the circulation device 140 through stripper rubbers (not shown) that can include rotating control heads as are well known and commercially available. The "stripper rubbers" seal around the tubulars 122, 124 and wipe them.

One of the upper chamber 142 and the lower chamber 144 is sized for accommodating connection and disconnection therein of the upper tubular 122 with the top tubular 124. A gate apparatus, shown schematically at 148, is provided between and in fluid communication with the upper chamber 142 and the lower chamber 144. Any apparatus capable of selectively opening may be used for the gate 148.

In certain embodiments according to the present invention, the chambers 142, 144 are together movable with respect to the support structure 110 and with respect to the platform 116 or rig floor on which the rig assembly 100 is mounted. Examples of suitable circulation devices are more fully disclosed in U.S. Pat. No. 6,412,554 entitled "Wellbore Circulation System." The '554 patent is hereby incorporated by reference in its entirety.

Drilling fluid from any suitable known drilling fluid/mud processing system (not shown) is selectively pumped through the chambers 142, 144 within the circulation device 140. A first inlet line 404 feeds into the lower chamber 144, while a first outlet line 402 returns fluids from the upper chamber 142. Outlet line 402 returns fluid from the circulation device 140 to the mud processing system. Valves 405, 403 are provided to selectively open and close the respective flow through lines 404, 402.

A second inlet line 422 is also provided. Flow through the second inlet line 422 is selectively controlled by valve 423. The second inlet line 422 feeds into the drill swivel 121 at the top of the top drive mechanism 120. From there, and when valve 423 is open, fluid flows through the top drive adapter 200 and then into the upper tubular 122.

In the rotary drilling position shown in FIG. 1, the inlet valve 405 is open to permit fluid to flow into the circulation device 140. More specifically, fluid flows into the lower chamber 144 of the circulating device 140. The gate 148 is maintained in its closed position to prohibit fluids from flowing upward. Fluids are thus forced downward through the top tubular 124 and through the tubular string 126. It is understood that the tubular string 126 extends from surface and into the wellbore 105. During the time necessary to position the next tubular 120 with the top drive adapter 200 and in axial alignment with the tubular string 126, the gate 148 remains in the closed position and the rotary drive 140 continues drilling. This stage of the drilling process includes the advancement of the drill string 126 with the incremental lowering of the axial displacement piston 300.

It is not desirable that the top end of the top tubular 124 travel below the bottom opening of the lower fluid chamber 144 during this stage of the process. Accordingly, the upper tubular 122 should be lowered into the fluid circulating device 140 and mated to the top tubular 124 therein. To accomplish this, the upper tubular 122 is aligned with the drill string 126, and then lowered into the top opening of the upper chamber 142. Once the lower end of the upper tubular 122 enters the upper chamber 142 and passes through the stripper rubbers, the gate 148 can be opened.

Figure 4:
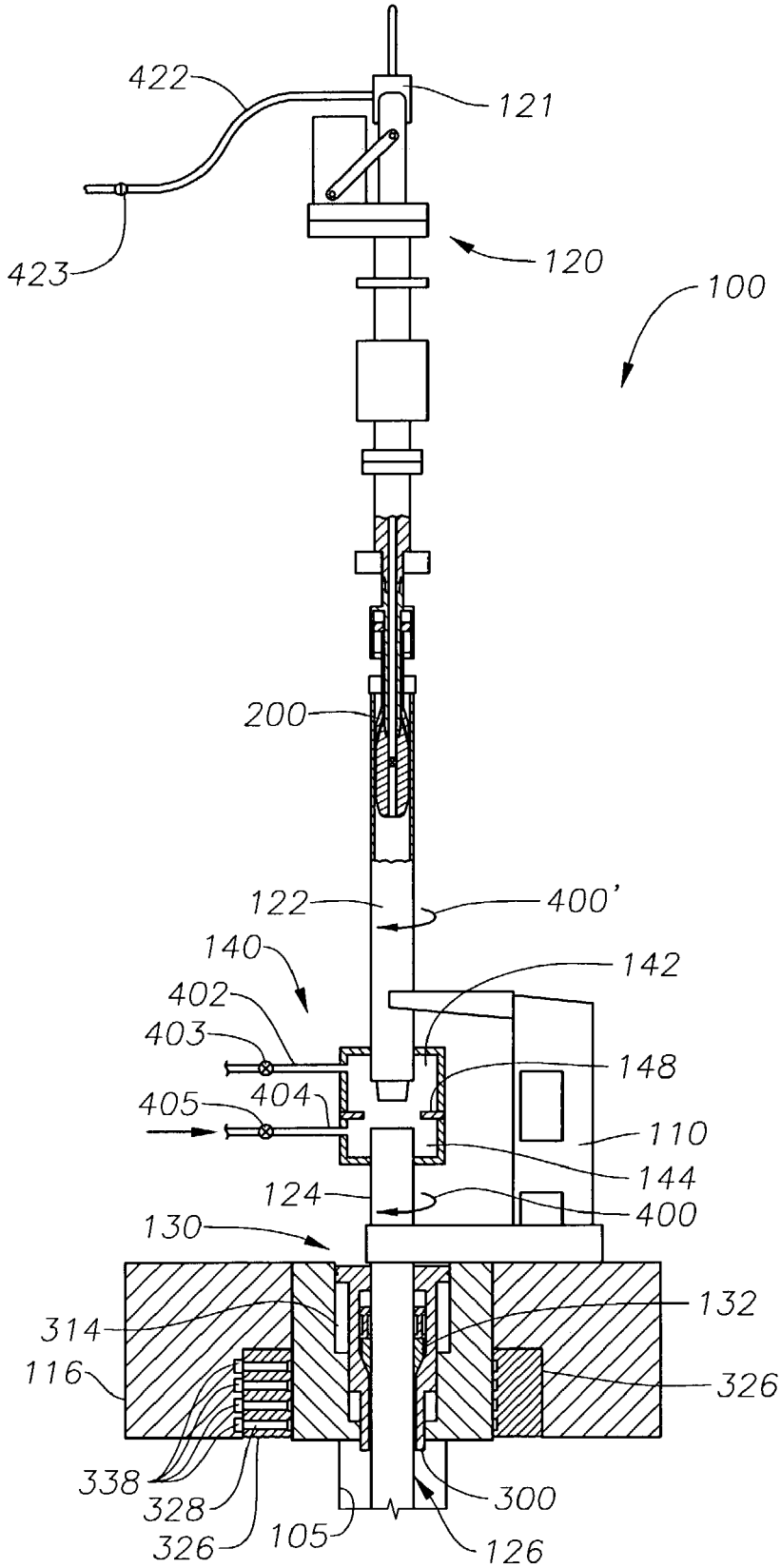
FIG. 4 presents a sectional view of the rig assembly of FIG. 1. In this view, the upper tubular is aligned axially above the top tubular of the tubular string. The bottom end of the upper tubular has entered the upper chamber of the circulating device. At the same time, the top end of the top tubular is positioned within the lower chamber of the circulation device. Rotation of the drill string continues to be imparted by the rotary drive.

FIG. 4 shows the upper tubular 122 engaged by the top drive adapter 200 and in axial alignment with the tubular string 126 therebelow. Movement of drawworks (not shown) of the rig assembly 100 controls the axial position of the tubular 122. Optionally, the circulation device 140 is moveable with respect to the support structure 110 by such operations as extending or retracting pistons of cylinders (not shown) on the support structure 110. Known control apparatuses, flow lines, switches, consoles, etc. that are wired or wireless, operator controlled and/or automatic, may be used to effect correct axial positioning of the upper tubular 122 and the circulation device 140 with respect to the tubular string 126 throughout the entire process.

The top drive adapter 200 transfers forces exerted by the top drive 120 onto the upper tubular 122 by selectively engaging an inner surface of the tubular 122 with hydraulically actuated and radially extendable tubular gripping members 210; however, other types of tubular gripping members are equally applicable in accordance with aspects of the present invention. Examples of suitable top drive adapters are disclosed in U.S. patent application Ser. No. 09/918,233 and publication number US 2001/0042625 entitled "Apparatus for Facilitating the Connection of Tubulars Using a Top Drive." That patent application is again incorporated by reference.

As illustrated in FIG. 4, the upper tubular 122 is positioned within the circulation device 140. The gate 148 is in an open position to provide an area within the circulation device 140 wherein a connection between the upper tubular 122 and the top tubular 124 can be made. The drawworks of the rig assembly 100 lowers the top drive 120, the top drive adapter 200, and subsequently the attached tubular 122 so that the bottom end of the upper tubular 120 enters through the top opening of the upper chamber 142 of the circulation device 140. Preferably, the upper tubular 122 enters the circulation device 140 through stripper rubbers (not shown) that can include rotating control heads as are commercially available.

Prior to opening the gate 148, operation of the circulation device 140 equalizes pressures between the upper and lower chambers 142, 144 through the use of a choke (not shown) or other suitable flow controller to control the rate of fluid pressure increase so that fluid at desired pressure is reached in one or both chambers 142, 144 and damage to the circulation device 142, 144 and items therein is inhibited or prevented.

As shown in FIG. 4, the valve 423 of the second inlet line 422 is open in order to provide a mud flow path through the drill swivel 121, the top drive 120, the top drive adapter 200, and the upper tubular 122. Initially, the rotary drive 140 and top drive 120 turn the tubular string 126 and the upper tubular 122, respectively, at the same rate of speed. These rates of speed are indicated by arrows 400 and 400'. As illustrated in FIG. 4, a double arrow 400 indicates that the rotary drive 140 is turning the tubular string 126 at a faster rate than the top drive 120 is rotating the upper tubular 122 (indicated by arrow 400'). Alternatively, the top drive 120 can be slowed relative to the rotary drive 140. Since the tubular string 126 and the tubular 120 have mating pin ends and box ends (not shown), the difference in rotational speed is used to make up a threaded connection between the bottom end of the top tubular 122 and the top end of the top tubular 124. Once the connection is made, fluid flow through the tubular string 126 is provided through the second inlet line 422.

Figure 5:
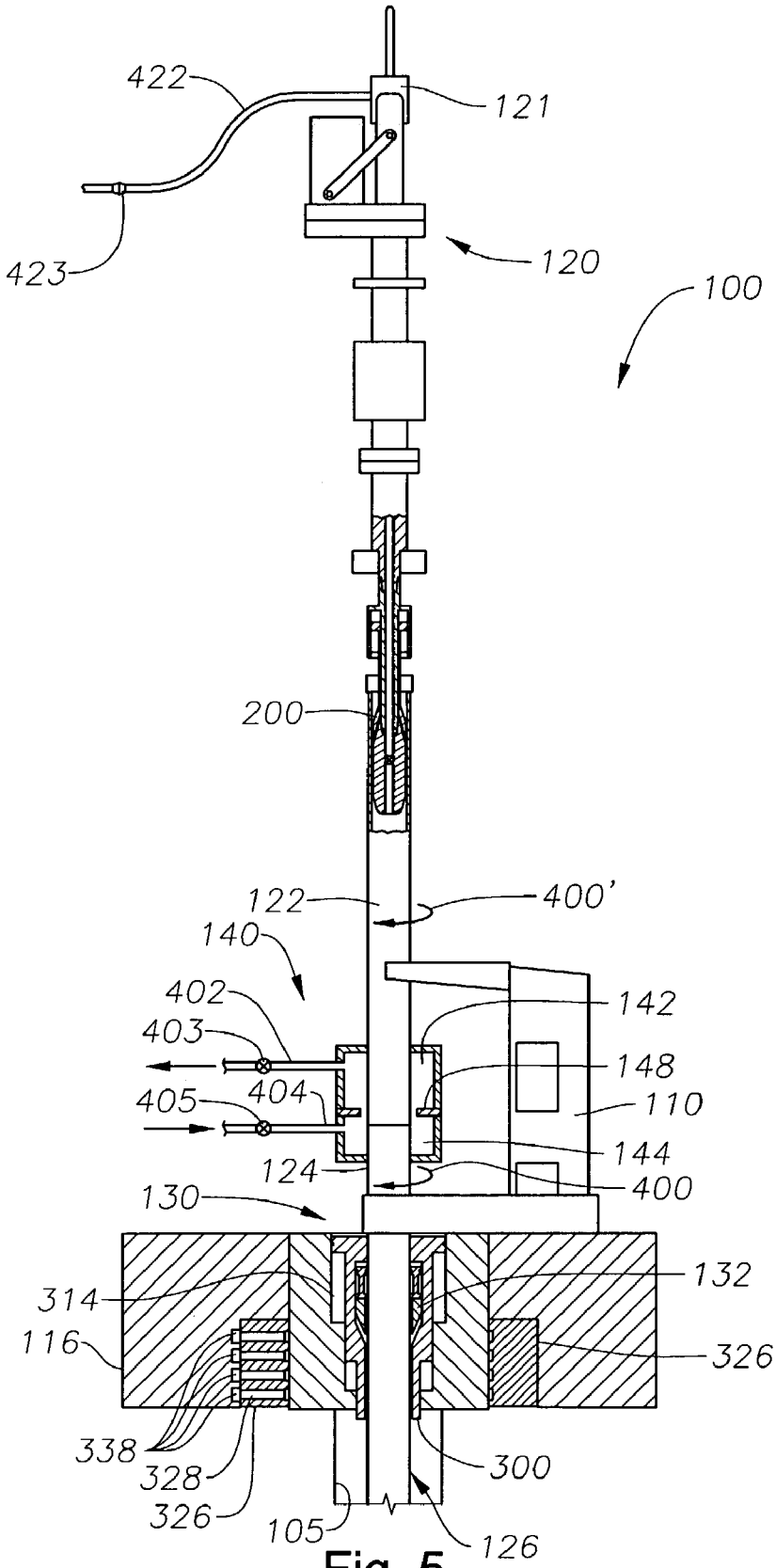
FIG. 5 shows a sectional view of the rig assembly of FIG. 4. In this view, the bottom end of the upper tubular is being made up to the top end of the top tubular. To accomplish this, the upper tubular is rotated at a higher rate of revolutions than the top tubular.
Figure 6:
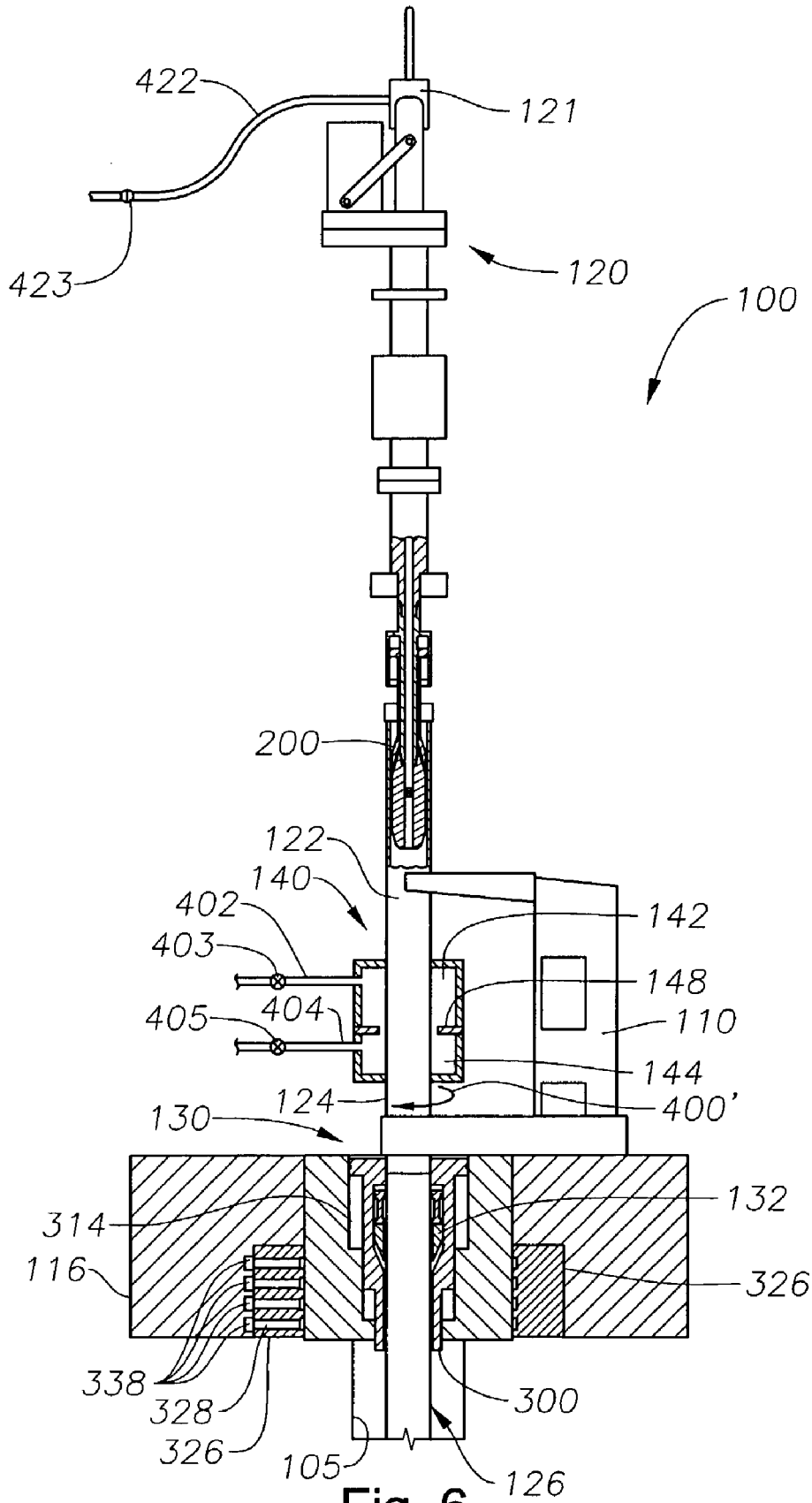
FIG. 6 provides a sectional view of the rig assembly of FIG. 5. Here, the upper tubular and the top tubular have been threadedly connected to form the newly lengthened drill string. The drill string is being rotated and downwardly advanced by the top drive mechanism. Thus, the rig assembly is now in its top drive drilling position.

FIG. 5 illustrates the rig assembly 100 in a top drive drilling position. In this position, the slips 132 of the rotary drive 140 are disengaged from the top tubular 124. The axial displacement piston 300 is returned to its highest position within the rotary drive 140. In this manner, the rotary drive mechanism 140 will be ready to assume the rotary drive position as shown in FIG. 1 when the top drive 120 can no longer advance the tubular string 126 into the wellbore 105. The top drive mechanism 120 continues to advance the tubular string 126 into the wellbore 105 until the top end of the upper tubular 122 is in the lower chamber 142 of the circulation device 140 (such as was shown in FIG. 1).

At this point, the top drive adapter 200 is operated in order to release the upper tubular 122 that was added to the tubular string 126. This frees the top drive adapter 200 in order to accept the next tubular to be added to the tubular string 126. The upper tubular becomes the new top tubular of the drill string 126. One skilled in the art could envision based upon this disclosure using embodiments as described herein in a reverse order with the purpose of quickly "breaking out" tubulars from a tubular string.

Next, the rotary drive 140 is operated to engage the slips 132 to the new top tubular 124. In this way, the rotary drive 140 can rotate and axially translate the new top tubular 124 and begin the entire process over, starting at FIG. 1.

By providing fluid to at least one of the chambers 142, 144 in the circulation device 140 when the chambers are isolated from each other or to both chambers when the gate 148 is in the open position, continuous circulation of fluid is maintained to the tubular string 126. This is possible with the gate 148 in the open position when the upper tubular 122 and tubular string 126 are connected, and with the gate 148 in the closed position with flow through the lower chamber 144 into the tubular string 126 when the top drive mechanism 120 is released from the tubular string 126. Once the upper tubular 120 and top tubular 124 are connected, flow through the drill string 126 is provided through the second inlet 422 and the upper tubular 120. Optionally, although the continuous circulation of drilling fluid is maintained, the rate can be reduced to the minimum necessary, e.g. the minimum necessary to suspend cuttings.

As described herein, embodiments of the present invention provide a method for continuously rotating a drill string and continuously advancing the drill string axially in a wellbore while continuously circulating fluid through the drill string. Therefore, it is possible to continuously drill through formations while forming the wellbore without interrupting the drilling process. In certain particular methods for "make up" of drill pipes according to the present invention in which a circulation device, a rotary drive, a top drive, and a top drive adapter are utilized according to the present invention, the top drive rotates and advances a drill string into the wellbore until a top of the drill string is positioned within the circulation device, and the top drive provides a path for mud flow therethrough. Next, the rotary drive is activated to match the rotating speed of the drill string, and slips are activated within the rotary drive to prevent rotation and axial movement between the rotary drive and the drill string. The top drive adapter then disengages from the top of the drill string. Mud flow is now provided to the drill string through an inlet line connected to the circulation device. If necessary, the height of the circulation device with respect to the top of the drill string is continually adjusted. The rotary drive continues to rotate the drill string and advance it into the wellbore through the use of a hydraulically operated axial displacement piston within the rotary drive. Once the top drive accepts from the rig's pipe rack with any suitable known pipe movement-manipulating apparatus the next drill pipe to be added to the drill string, engages the drill pipe with the top drive adapter, and axially aligns the drill pipe above the drill string, and the drill pipe is lowered into the circulation device. At this point a gate apparatus within the circulation device is in the open position and circulation of mud is established through the top drive and the next drill pipe to be added. The top drive initially matches the speed of rotation of the rotary drive. When the drill pipe contacts the drill string for mating, the rotary drive increases its speed to form a connection between the drill pipe and the drill string. Next, the rotary drive releases the drill string and the axial displacement piston returns to its highest position in order to repeat the process as many times as necessary to advance the drill string to the desired depth. A similar method using embodiments of the present invention as described except in reverse order can be used to quickly "break out" tubulars from a tubular string.

While the foregoing is directed to embodiments of the present invention, other and further embodiments of the invention may be devised without departing from the basic scope thereof, and the scope thereof is determined by the claims that follow.

The invention claimed is:

1. A method for connecting an upper tubular to a top tubular of a tubular string, comprising the steps of:

operating a rotary drive to provide rotational and axial movement of the tubular string in a wellbore, wherein the step of operating the rotary drive to provide axial movement of the tubular string includes adjusting fluid pressure applied to a hydraulically operated axial displacement piston within the rotary drive;

positioning the upper tubular above the top tubular of the tubular string, the upper tubular configured to have a bottom threaded end that connects to a top threaded end of the top tubular;

changing a relative speed between the upper tubular and the top tubular to threadedly mate the bottom threaded end of the upper tubular and the top threaded end of the top tubular such that the upper tubular becomes a part of the tubular string;

releasing the tubular string from engagement with the rotary drive; and operating a top drive to provide rotational and axial movement of the tubular string in the wellbore, wherein the top drive includes a member that is forced in a radial direction to grip the upper tubular.

2. The method of claim 1, wherein the bottom threaded end of the upper tubular and the top threaded end of the top tubular are threadedly mated within a fluid circulating device; and further comprising the step of circulating a fluid continuously through the tubular string, wherein the fluid is selectively provided through the circulation device or through a flow path through the upper tubular.

3. The method of claim 2, further comprising adjusting a height of the fluid circulating device with respect to a top of the top tubular.

4. The method of claim 1, wherein the rotary drive is substantially flush with a drilling rig floor.

5. The method of claim 1, wherein changing the relative speed comprises turning the upper tubular faster.

6. The method of claim 1, wherein changing the relative speed comprises turning the tubular string slower.

7. A method for connecting an upper tubular to a top tubular of a tubular string while continuously drilling, comprising the steps of:

operating a rotary drive to provide rotational and axial movement of the tubular string in the wellbore, wherein the step of operating the rotary drive to provide axial movement of the tubular string includes adjusting fluid pressure applied to a hydraulically operated axial displacement piston within the rotary drive;

positioning the upper tubular above the top tubular of the tubular string, the upper tubular configured to have a bottom threaded end that connects to a top threaded end of the top tubular;

changing a relative speed between the upper tubular and the top tubular to threadedly mate the bottom threaded end of the upper tubular and the top threaded end of the top tubular such that the upper tubular becomes a part of the tubular string;

releasing the tubular string from engagement with the rotary drive; and operating a top drive to provide rotational and axial movement of the tubular string in the wellbore.

8. A method of breaking out an upper tubular from a tubular string, comprising:

providing a rig assembly, the rig assembly comprising a top drive mechanism, a rotary drive mechanism, and a fluid circulation device;

operating the top drive mechanism to provide rotational and axial movement of the tubular string in the wellbore until a joint of the upper tubular with the tubular string is positioned within the circulation device, wherein the top drive mechanism includes a member that is forced in a radial direction for engaging the upper tubular;

activating the rotary drive mechanism, thereby matching a rotating speed of the tubular string and engaging the tubular string to prevent rotational and axial movement between the rotary drive mechanism and the tubular string;

changing a relative speed between the upper tubular and the tubular string to break a threaded connection between the upper tubular and the tubular string;

operating the rotary drive mechanism to provide rotational and axial movement of the tubular string in the wellbore, wherein operating the rotary drive mechanism to provide axial movement of the tubular string includes adjusting fluid pressure applied to a hydraulically operated axial displacement piston within the rotary drive mechanism; and disengaging the top drive mechanism from the upper tubular.

9. The method of claim 8, wherein changing the relative speed comprises slowing the upper tubular.

10. The method of claim 8, wherein the rotary drive mechanism is substantially flush with a drilling rig floor.

11. The method of claim 8, wherein engaging the tubular with the rotary drive mechanism includes setting a slip assembly operatively connected to the axial displacement piston for selectively preventing rotational and axial movement between the axial displacement piston and the tubular string therein.

12. The method of claim 11, wherein the axial displacement piston is rotationally locked to the rotary drive mechanism.

13. The method of claim 12, wherein the axial displacement piston is rotationally locked to the rotary drive mechanism by a slot and key locking assembly.

14. A method for connecting an upper tubular to a tubular string comprising the steps of:

providing a rig assembly, the rig assembly comprising a top drive mechanism, a rotary drive mechanism, and a fluid circulation device;

operating the top drive mechanism to provide rotational and axial movement of the tubular string in the wellbore until a top of the tubular string is positioned within the circulation device activating the rotary drive, thereby matching a rotating speed of the tubular string and engaging the tubular string to prevent rotational and axial movement between the rotary drive and the tubular string;

disengaging the top drive mechanism from the tubular string;

operating the rotary drive to provide rotational and axial movement of the tubular string in the wellbore connecting the upper tubular to the top drive mechanism;

aligning axially the upper tubular above the tubular string, the upper tubular engaged by the top drive mechanism and positioned to have a bottom end of the upper tubular in the circulation device adjacent a top end of the tubular string, wherein the top drive includes a member that is forced in a radial direction for engaging the upper tubular activating the top drive to substantially match the rotating speed of the tubular string as the bottom end of the upper tubular contacts the top end of the tubular string for connecting;

changing a relative speed between the upper tubular and the tubular string to form a threaded connection between the upper tubular and the tubular string', and releasing the tubular string from engagement with the rotary drive, and wherein operating the rotary drive mechanism to provide axial movement of the tubular string includes adjusting fluid pressure applied to a hydraulically operated axial displacement piston within the rotary drive mechanism.

15. A method for connecting an upper tubular to a tubular string, comprising the steps of:

providing a rig assembly, the rig assembly comprising a top drive mechanism having a top drive adapter operatively connected thereto, a rotary drive mechanism, and a fluid circulation device, wherein the top drive adapter comprises a mud-check valve;

operating the top drive mechanism to provide rotational and axial movement of the tubular string in the wellbore until a top of the tubular string is positioned within the circulation device;

activating the rotary drive mechanism, thereby matching a rotating speed of the tubular string and engaging the tubular string to prevent rotational and axial movement between the rotary drive mechanism and the tubular string;

disengaging the top drive mechanism from the tubular string;

operating the rotary drive mechanism to provide rotational and axial movement of the tubular string in the wellbore, wherein operating the rotary drive mechanism to provide axial movement of the tubular string includes adjusting fluid pressure applied to a hydraulically operated axial displacement piston within the rotary drive mechanism;

gripping the upper tubular with the top drive adapter;

aligning axially the upper tubular above the tubular string, the upper tubular engaged by the top drive adapter and positioned to have a bottom end of the upper tubular in the circulation device adjacent a top end of the tubular string;

activating the top drive mechanism to rotate the top drive adapter and upper tubular and substantially match the rotating speed of the tubular string as the bottom end of the upper tubular contacts the top end of the tubular string for connecting;

changing a relative speed between the upper tubular and the tubular string to form a threaded connection between the upper tubular and the tubular string; and releasing the tubular string from engagement with the rotary drive mechanism.

16. The method of claim 15, wherein a portion of the tubular string comprises casing.

17. The method of claim 15, wherein the top drive adapter comprises radially movable gripping members.

18. The method of claim 15, wherein the rotary drive mechanism is substantially flush with a drilling rig floor.

19. The method of claim 15, wherein changing the relative speed comprises turning the upper tubular faster.

* * * * *